US008707652B2

(12) United States Patent
Kim et al.

(10) Patent No.: US 8,707,652 B2
(45) Date of Patent: Apr. 29, 2014

(54) BUILDING BLOCK, BUILDING STRUCTURE AND THE METHOD OF BRICKING WALL USING THE SAME

(76) Inventors: Kyu-Hue Kim, Chungcheongnam-Do (KR); Kang-Suck Kim, Chungcheongnam-Do (KR)

( * ) Notice: Subject to any disclaimer, the term of this patent is extended or adjusted under 35 U.S.C. 154(b) by 220 days.

(21) Appl. No.: 12/307,335

(22) PCT Filed: Mar. 28, 2008

(86) PCT No.: PCT/KR2008/001763

§ 371 (c)(1),
(2), (4) Date: Jan. 2, 2009

(87) PCT Pub. No.: WO2009/075412

PCT Pub. Date: Jun. 18, 2009

(65) Prior Publication Data

US 2010/0236179 A1 Sep. 23, 2010

(30) Foreign Application Priority Data

Dec. 12, 2007 (KR) ..... 10-2007-0128631
Mar. 28, 2008 (KR) ..... 10-2008-0028845

(51) Int. Cl.
*E04B 5/04* (2006.01)
*E04B 2/42* (2006.01)

(52) U.S. Cl.
CPC ..... *E04B 2/42* (2013.01)
USPC ..... 52/605; 52/425; 52/592.1

(58) Field of Classification Search
USPC ..... 52/425–428, 432, 562, 565, 606, 605, 52/405.2, 591.2, 585, 405, 479; D25/118
See application file for complete search history.

(56) References Cited

U.S. PATENT DOCUMENTS 2,684,589 A * 7/1954 Perreton ..... 52/591.2
3,358,355 A * 12/1967 Youssi et al. ..... 29/424

(Continued)

FOREIGN PATENT DOCUMENTS

CN 2584699 Y 5/2003
DE 29606867 A1 10/1997

(Continued)

OTHER PUBLICATIONS

Australian Office Action dated May 12, 2011 for Patent Application No. 2008336523.

(Continued)

*Primary Examiner* — William Gilbert
*Assistant Examiner* — Gisele Ford
(74) *Attorney, Agent, or Firm* — Scully, Scott, Murphy & Presser, P.C.

(57) ABSTRACT

The present invention relates to a building block serving as a mold when carrying out civil engineering and construction works and forming an external appearance of a structure, a building structure and a method of bricking a wall using the same. The building block comprises first and second exterior walls facing each other and spacing from each other in back and forth directions, and a connecting portion connecting the first and second exterior walls to each other and having an upper portion provided with a first mounting groove for mounting a width-directional reinforcing bar. Here, concavo-convex coupling portions are formed at inner peripheries of the first and second exterior walls, for concavo-convexly coupling to each adjacent block, and here, leakage preventing recesses are respectively formed at outer peripheries of the first and second exterior walls.

12 Claims, 11 Drawing Sheets

(56) References Cited

U.S. PATENT DOCUMENTS

| | | | | | |
|---|---|---|---|---|---|
| 4,514,949 | A | | 5/1985 | Crespo | |
| 4,574,550 | A | | 3/1986 | Maschhoff | |
| 4,706,429 | A | | 11/1987 | Young | |
| 4,856,249 | A | * | 8/1989 | Nickerson | 52/405.4 |
| 5,735,090 | A | | 4/1998 | Papke | |
| 5,809,728 | A | | 9/1998 | Tremelling | |
| 5,855,102 | A | * | 1/1999 | Chang | 52/604 |
| 5,901,520 | A | * | 5/1999 | Abdul-Baki | 52/592.6 |
| 6,025,726 | A | * | 2/2000 | Gershenfeld et al. | 324/671 |
| 6,134,853 | A | * | 10/2000 | Haener | 52/405.2 |
| 6,513,293 | B2 | * | 2/2003 | Miller | 52/405.1 |
| 6,691,481 | B2 | | 2/2004 | Schmidt | |
| 7,096,634 | B2 | * | 8/2006 | Dean, Jr. | 52/574 |

FOREIGN PATENT DOCUMENTS

| | | | |
|---|---|---|---|
| FR | 2788071 | A1 | 7/2000 |
| GB | 2400617 | A | 10/2004 |
| JP | 46-062716 | U | 7/1971 |
| JP | 48-44571 | U | 12/1973 |
| JP | 61-286441 | A | 12/1986 |
| JP | 2-91341 | A | 3/1990 |
| JP | 9-49322 | A | 2/1997 |
| JP | 11-247333 | A | 9/1999 |
| JP | 2002-534624 | A | 10/2002 |
| JP | 2006-314163 | A | 11/2006 |
| KR | 20-0018197 | | 5/1980 |
| KR | 20-0374953 | | 2/2005 |
| WO | 2007143820 | A1 | 12/2007 |

OTHER PUBLICATIONS

Supplementary European Search Report dated Jul. 26, 2010.

Chinese Office Action dated Nov. 20, 2011 issued in Chinese Application No. 200880000411.3.

* cited by examiner

BUILDING BLOCK, BUILDING STRUCTURE AND THE METHOD OF BRICKING WALL USING THE SAME

TECHNICAL FIELD

The present invention relates to a building block serving as a mold when carrying out civil engineering and construction works and forming an external appearance of a structure, a building structure and a method of bricking a wall using the same.

BACKGROUND ART

Generally, when carrying out a civil engineering and construction work, several stages of processes are performed. Thus, it is required to take a long term of works, waste additional materials and use heavy-weight materials. Also, a lot of professional human resources are supplied thereto, causing a building cost to increase. And, leakage frequently occurs due to problems on the material and the construction. Furthermore, several problems exist, such as pollution generated from the materials, fire, cracks, efflorescence phenomena, etc.

Particularly, a bearing wall and a non-bearing wall of the building structure are fabricated by forming a wall space into a desired shape generally using a mold, infusing mortar made of cement and coarse sand into the wall space in a state that a reinforcing bar is placed and curing the mortar. Alternately, the bearing wall and the non-bearing wall are fabricated by bricking cement blocks or cement bricks made of cement and coarse sand, or bricking another kind of bricks. And, an exterior wall of the bearing wall is plastered with the cement mortar or finished by facing a tile or by bricking clay bricks.

However, when forming a cement mortar wall according to the related art method, efflorescence occurs, that is, the cement mortar is partially dissolved and outwardly flows due to an introduction of rainwater, causing the exterior wall of a building to be stained. And, in order to remove the efflorescence, the exterior wall should be recoated with paint.

Also, the related art bearing and non-bearing walls are weakened in intensity and have cracks due to a load of the building, as time elapses.

In addition, it is required to spend much time on bricking bricks or blocks and plastering, much money on skilled and professional human resources, and much time and cost on repairing processes for leakage, cracks, efflorescence or the like.

DISCLOSURE OF THE INVENTION

Technical Problem

Therefore, it is an object of the present invention to provide:

(1) a building block serving as a mold when carrying out engineering and construction works and forming an external appearance of a structure, (2) a building block having a structure capable of minimizing leakage, cracks, efflorescence, etc. of the building structure, (3) a block structure capable of firmly placing a reinforcing bar therein in length and width directions, and (4) a building structure which can be easily built by any person without a professional worker in reduced term of works.

Technical Solution

The objects will be achieved by following configurations of the present invention.

(1) In accordance with one aspect of the present invention, there is provided a building block comprising: first and second exterior walls facing each other and spacing from each other in back and forth directions; and a connecting portion connecting the first and second exterior walls to each other and having an upper portion provided with a first mounting groove for mounting a width-directional reinforcing bar, wherein concavo-convex coupling portions are formed at inner peripheries of the first and second exterior walls, for concavo-convexly coupling to each adjacent block, and wherein leakage preventing recesses are respectively formed at outer peripheries of the first and second exterior walls.

(2) In accordance with another aspect of the present invention, there is provided a building structure using four types of building blocks (first to fourth blocks) in accordance with (1), the building structure comprising: a first line in which the first and second blocks are concavo-convexly coupled to each other and adhered to each other, alternatively right and left, and a width-directional reinforcing bar mounted at first mounting grooves of the first and second blocks is provided; a second line in which the third and fourth blocks are concavo-convexly coupled to each other and adhered to each other, alternatively right and left, and a width-directional reinforcing bar mounted at first mounting grooves of the third and fourth blocks is provided; length-directional reinforcing bars placed in the first to fourth blocks; and a filler filled in the first to fourth blocks, wherein the first and second lines are bricked by being concavo-convexly coupled and adhered to each other, alternatively right and left, wherein the third and fourth blocks are zigzag bricked so as to be respectively engaged with the first and second blocks.

(3) In accordance with still another aspect of the present invention, there is provided a method of bricking a wall using a building block, the method comprising: bricking a first line in which first and second blocks are concavo-convexly coupled to each other and adhered to each other, alternatively right and left, and a width-directional reinforcing bar mounted at first mounting grooves of the first and second blocks is provided; bricking a second line in which third and fourth blocks are concavo-convexly coupled to each other and adhered to each other, alternatively right and left, and a width-directional reinforcing bar mounted at first mounting grooves of the third and fourth blocks is provided; placing length-directional reinforcing bars in the first to fourth blocks; and filling a filler in the first to fourth blocks, wherein the bricking of the first and second lines are performed by being adhered to each other, alternatively upward and downward, wherein the third and fourth blocks are zigzag bricked so as for the third and fourth blocks to be simultaneously and concavo-convexly coupled to the first and second blocks, respectively.

MODES FOR CARRYING OUT THE PREFERRED EMBODIMENTS

Hereafter, description will now be given in detail of preferred embodiments of the present invention with accompanying drawings.

Figure 1:
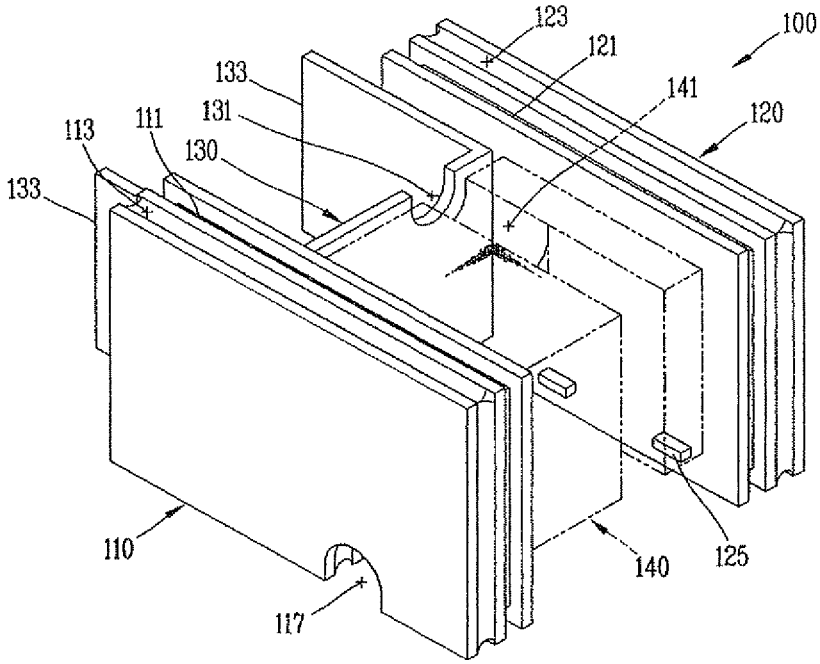
FIGS. 1 to 3 are a perspective view, a planar view and a right side view respectively showing a first block in accordance with one embodiment of the present invention.
Figure 2:
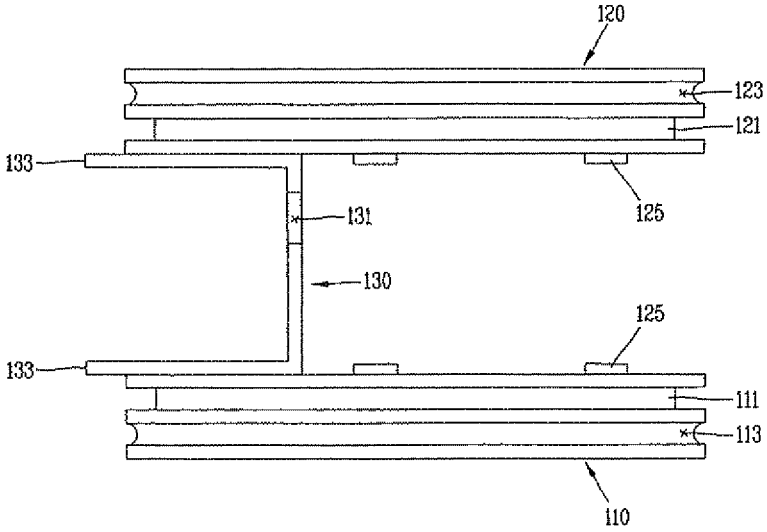
Figure 3:
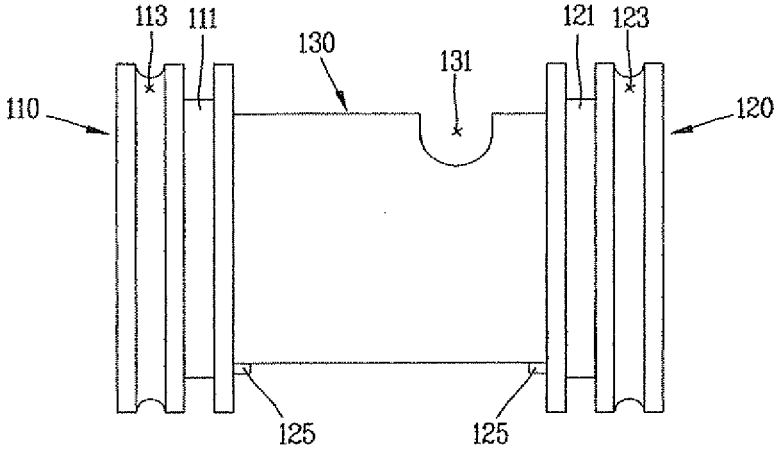

Referring to FIGS. 1 to 3, a building block in accordance with a first embodiment of the present invention, namely, a first block 100 includes first and second exterior walls 110, 120 facing each other and spacing from each other in back and forth directions, and a connecting portion 130 connecting the first and second exterior walls to each other and having an upper portion provided with a first mounting groove 131 for mounting a width-directional reinforcing bar.

Here, concavo-convex coupling portions 111, 121 are respectively formed at each inner periphery of the first and second exterior walls 110, 120. The concavo-convex coupling portions 111, 121 are formed in a complementary shape with concavo-convex portions of adjacent blocks in upper, lower, right and left directions so as to be concavo-convexly coupled to the adjacent blocks. Particularly, the first block 100 in accordance with the first embodiment has the first and second exterior walls 110, 120 having inner peripheries, namely, peripheries in upper and lower directions and peripheries in right and left directions, formed in a concave shape, respectively.

And, leakage preventing recesses 113, 123 are formed at each outer periphery of the first and second exterior walls 110, 120 along the peripheries, respectively. The leakage preventing recesses 113, 123 serve to prevent efflorescence occurrence. Particularly, mortar filled in the block may flow out of the inner wall of the block by being dissolved due to an introduction of rainwater or the like. Even though the leakage of a solution is primarily restricted by a bonding process performed when concavo-convexly coupling the blocks, the solution may still leak, occasionally. Thus, the leakage preventing recesses 113, 123 are formed, accordingly the solution flows down the building along the leakage preventing recesses 113, 123 by gravity without leaking out of the exterior wall of the block.

Also, the first block 100 may further include a heat insulator 140 established at a space formed by the first and second exterior walls 110, 120 and the connecting portion 130, as shown in two-dot chain line in FIG. 1. As such, by establishing the heat insulator 140 in the exterior wall, not out of the exterior wall, it is capable of achieving a warmth-keeping effect and of simplifying the construction. In order to fix the heat insulator 140, a fixing member 125 such as a fixing protrusion may be formed on each inner surface of the wall of the first and second exterior walls 110, 120, respectively. And, a second mounting groove 141 may be formed on the upper surface of the heat insulator 140 so as to mount a width-directional reinforcing bar. The second mounting groove 141 is formed to match the first mounting groove 131. Further, as shown in FIG. 1, a space is formed between the heat insulator 140 in a length direction, thus it may be capable of passing through a length-directional reinforcing bar or filling the mortar.

And, as shown in FIGS. 1 and 2, the connecting portion 130 of the first block 100 has a cross section in a shape of "ㄷ", and both ends 133 thereof are more protruded than the first and second exterior walls 110, 120. The both ends 133 of the connecting portion 130 are engaged with ends of a heat insulator in an adjacent block on the same line (layer), thereby reinforcing the fixing of the blocks in the width direction. In the meantime, preferably, only one connecting portion 130 is provided so as to facilitate inserting of the reinforcing bar in the length direction and obtain a space for filling the mortar and/or a space for loading the heat insulator. However, it should be noted that two or more connecting portions may be provided depending on the bricking purposes.

In some cases, a pipe hole 117 for distributing wires or laying pipes may be formed at least one of the first and second exterior walls 110, 120. The pipe hole 117 can be easily formed in advance, thus it is not required to break the wall for forming the pipe hole after the bricking process.

And, preferably, detachable surface protecting films (not shown) are attached onto the outer surfaces of the first and second exterior walls 110, 120. The surface protecting films is attached to prevent the surfaces of the exterior walls from being damaged due to the mortar or foreign substances resulting from processes such as bricking of the blocks and filling of the mortar.

The block 100 may be formed of a ceramic material. For example, the ceramic material is infused into a mold having the aforementioned block structure and molded in a manner of an injection molding or a compression molding with a large amount. Then, a molded body is dried by a counter-flow tunnel drying manner and then firstly calcined at approximately 600~700° C. Thereafter, after performing a mural transfer processing on the outer surface of the exterior wall as necessary, the molded body is secondly calcined at 1250~1300° C., and then cooled. Finally, after enameling the molded body and attaching the surface protecting film thereonto, a block having a specific shape can be obtained. However, the block of the present invention is not limited to the aforementioned material and fabricating method.

Figure 4:
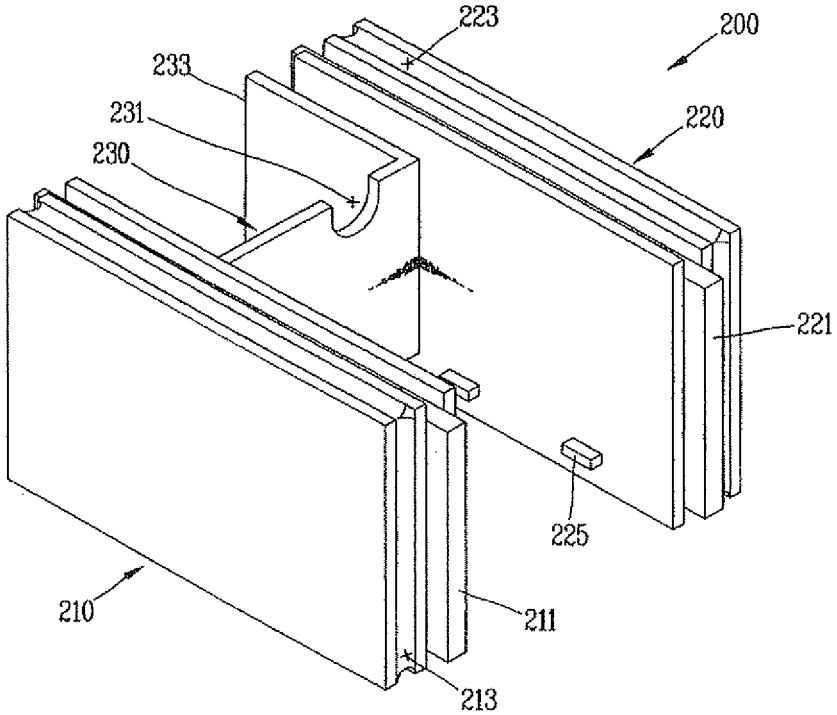
FIGS. 4 to 6 are a perspective view, a planar view and a right side view respectively showing a second block in accordance with another embodiment of the present invention.
Figure 5:
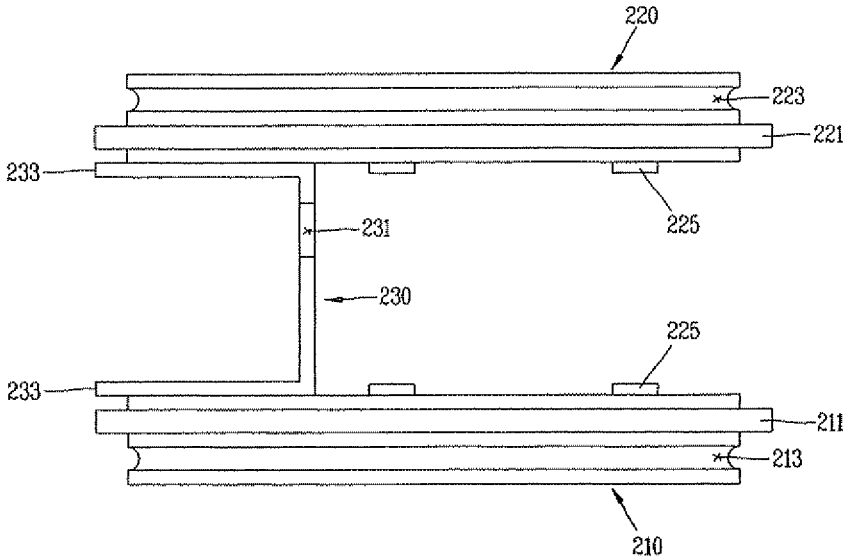
Figure 6:
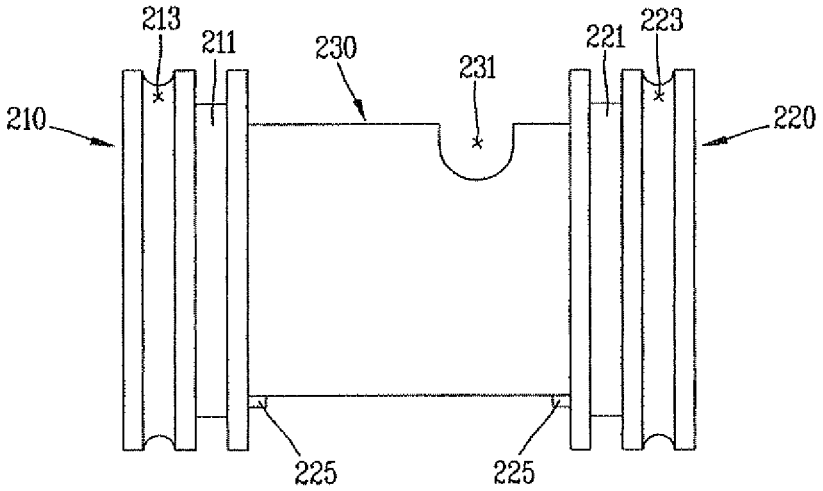

Meanwhile, a second block 200 in accordance with a second embodiment of the present invention is shown in FIGS. 4 to 6. The second block 200 in accordance with the second embodiment of the present invention includes first and second exterior walls 210, 220 facing each other and spacing from each other in back and forth directions, and a connecting portion 230 connecting the first and second exterior walls to each other and having an upper portion provided with a first mounting groove 231 for mounting a width directional reinforcing bar.

Here, concavo-convex coupling portions 211, 221 are respectively formed at each inner periphery of the first and second exterior walls 210, 220. Particularly, upper and lower parts of the inner peripheries of the first and second exterior walls 210, 220 are concave portions, while right and left parts thereof are convex portions. The second block 200 is concavo-convexly coupled to the first block 100 right and left, alternatively. Since the right and left parts of the inner peripheries of the first and second exterior walls 110, 120 of the first block are concave portions, corresponding portions of the second block are convex portions. Preferably, a height of upper and lower concave portions of the second block 200 is same as that of the upper and lower concave portions of the first block 100 in an aspect of concavo-convexly coupling following third and fourth blocks.

Referring to FIGS. 4 and 5, the connecting portion 230 has a cross section in a shape of "⊏", and both ends 233 thereof are protruded by the convex portions of the inner peripheries of the first and second exterior walls 210, 220. The both ends 233 are engaged with ends of the heat insulator within the first block 100, thereby reinforcing the fixing of the blocks in the width direction.

Else, regarding leakage preventing recesses 213, 223 respectively formed along the outer peripheries of the first and second exterior walls 210, 220, a heat insulator (not shown), a pipe hole (not shown), a surface protecting film (not shown), a material and a fabricating method of the block, etc., it may be same as the aforementioned description of the first embodiment.

Figure 7:
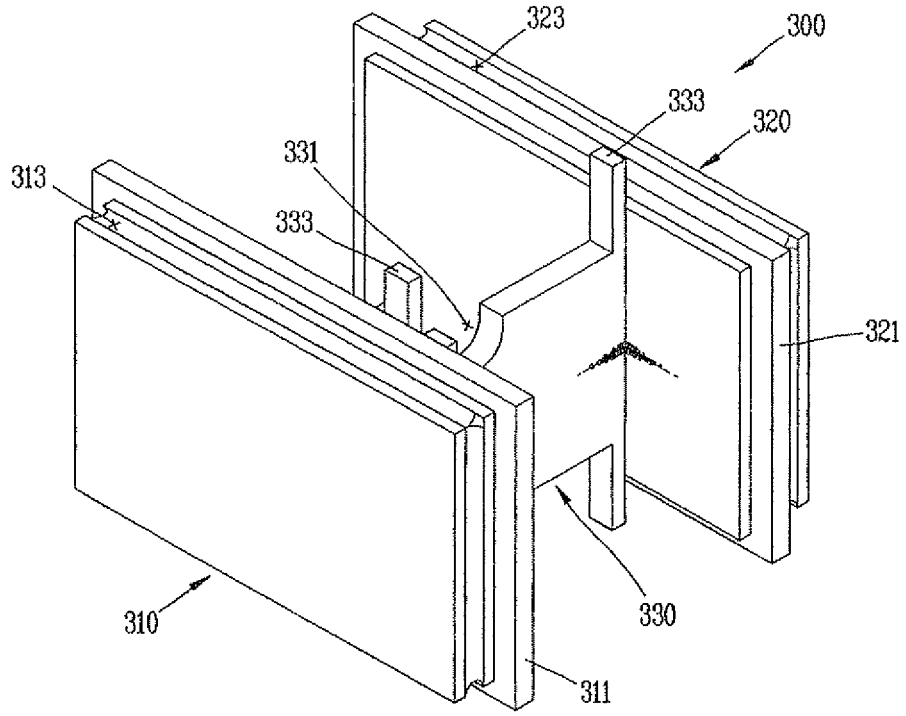
FIGS. 7 to 9 are a perspective view, a planar view and a right side view respectively showing a third block in accordance with still another embodiment of the present invention.
Figure 8:
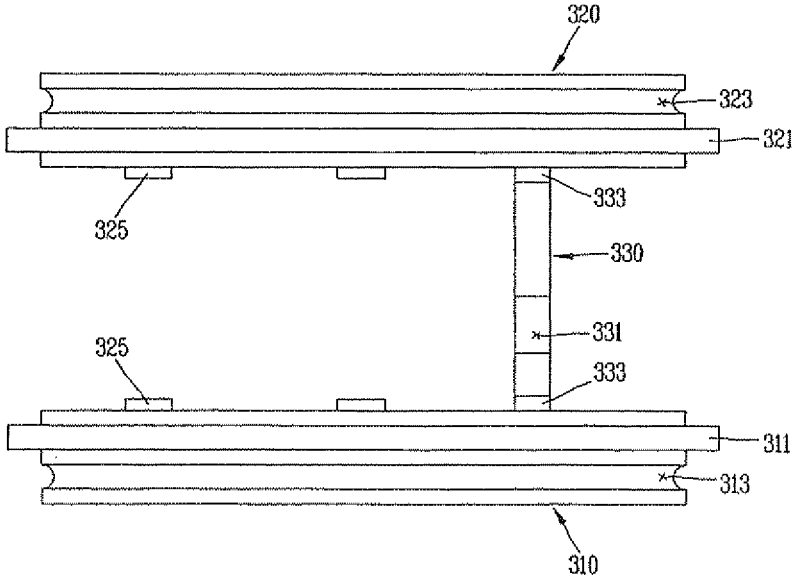
Figure 9:
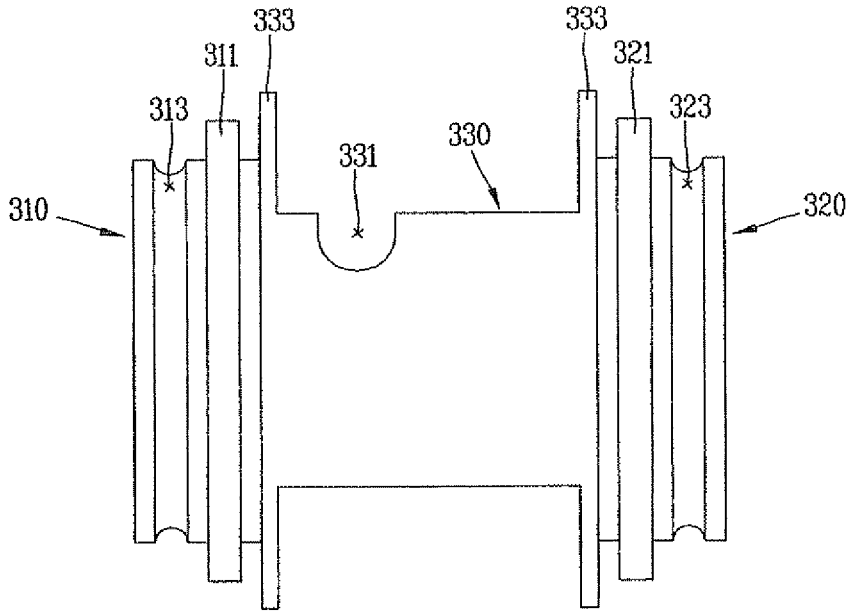

Meanwhile, a third block 300 in accordance with a third embodiment of the present invention is shown in FIGS. 7 to 9. The third block 300 in accordance with the third embodiment of the present invention includes first and second exterior walls 310, 320 facing each other and spacing from each other in back and forth directions, and a connecting portion 330 connecting the first and second exterior walls to each other and having an upper portion provided with a first mounting groove 331 for mounting a width directional reinforcing bar.

Here, concavo-convex coupling portions 311, 321 are respectively formed at each inner periphery of the first and second exterior walls 310, 320. Particularly, all of the inner peripheries of the first and second exterior walls 310, 320 in upper and lower directions and right and left directions are formed in a convex shape, respectively. The third block 300 is concavo-convexly coupled to the first and second blocks 100, 200 disposed at lines upper and/or lower than a line on which the third block is bricked, simultaneously. Since the upper and lower peripheries of the first and second blocks 100, 200 are concave portions, corresponding portions of the third block are convex portions. And, in order to be concavo-convexly coupled to the fourth block right and left, the right and left peripheries of the third block 300 are formed in the convex shape.

Referring to FIGS. 7 and 9, both ends 333 of the connecting portion 330 in back and forth directions are protruded by a degree equal to or more than the convex portions of the upper and lower peripheries. The both protruded ends 333 reach an inner surface of the exterior wall of the block disposed at upper and/or lower lines thereof thus to prevent the blocks from being fluctuated in the back and forth directions, thereby reinforcing the fixing of the blocks in the length direction.

Else, regarding leakage preventing recesses 313, 323 respectively formed along the outer peripheries of the first and second exterior walls 310, 320, a heat insulator (not shown), a pipe hole (not shown), a surface protecting film (not shown), a material and a fabricating method of the block, etc., it may be same as the aforementioned description of the first embodiment.

Figure 10:
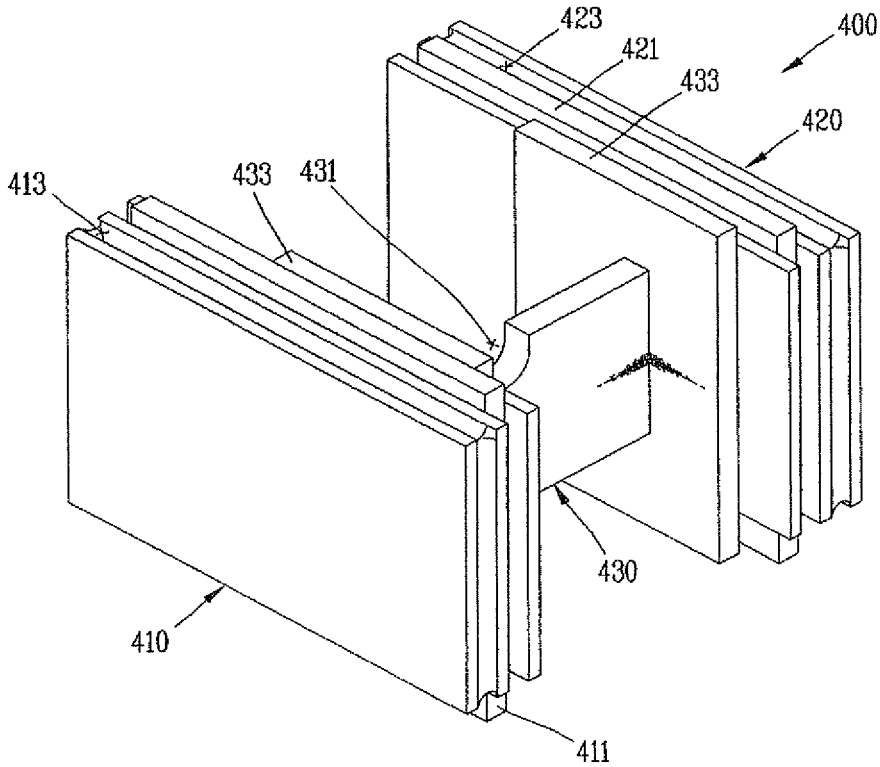
FIGS. 10 to 12 are a perspective view, a planar view and a right side view respectively showing a fourth block in accordance with yet still another embodiment of the present invention.
Figure 11:
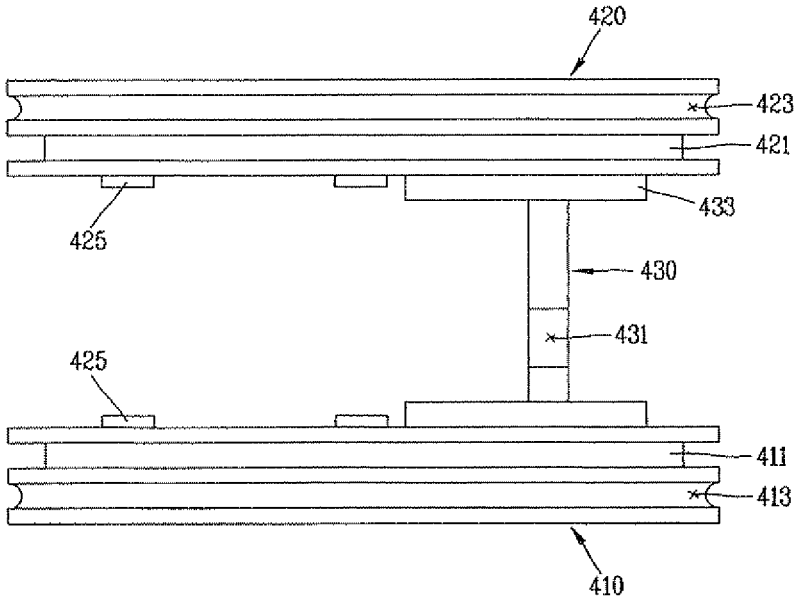
Figure 12:
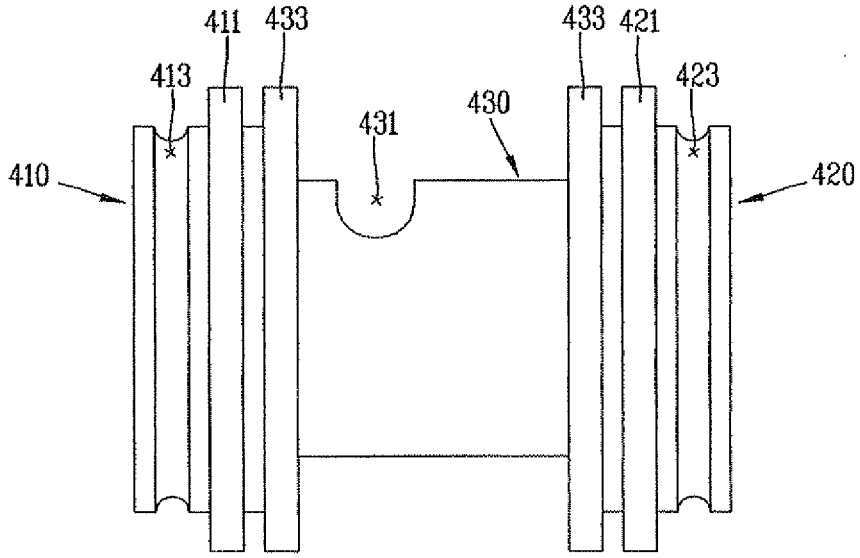

Meanwhile, a fourth block 400 in accordance with a fourth embodiment of the present invention is shown in FIGS. 10 to 12. The fourth block 400 in accordance with the fourth embodiment of the present invention includes first and second exterior walls 410, 420 facing each other and spacing from each other in back and forth directions, and a connecting portion 430 connecting the first and second exterior walls to each other and having an upper portion provided with a first mounting groove 431 for mounting a width-directional reinforcing bar.

Here, concavo-convex coupling portions 411, 421 are respectively formed at each inner periphery of the first and second exterior walls 410, 420. Particularly, upper and lower part of the inner peripheries of the first and second exterior walls 410, 420 are convex portions, while right and left parts thereof are concave portions. The fourth block 400 is concavo-convexly coupled to the first and second blocks 100, 200 disposed at lines upper and/or lower than a line on which the fourth block is bricked, simultaneously. Since the right and left parts of the inner peripheries of the first and second exterior walls 110, 120 of the first block are concave portions, corresponding portions of the fourth block are convex portions. Preferably, a height of upper and lower concave portions of the fourth block 400 is same as that of the upper and lower concave portions of the third block 300 in an aspect of concavo-convexly coupling the first and second blocks. And, in order to be concavo-convexly coupled to the third block right and left, the right and left peripheries of the fourth block 400 are formed in the concave shape.

Referring to FIGS. 10 and 12, both ends 433 of the connecting portion 430 in back and forth directions are protruded by a degree equal to or more than the convex portions of the upper and lower peripheries. The both protruded ends 433 reach an inner surface of the exterior wall of the block disposed at upper and/or lower lines thereof thus to prevent the blocks from being fluctuated in the back and forth directions, thereby reinforcing the fixing of the blocks in the length direction.

Else, regarding leakage preventing recesses 413, 423 respectively formed along the outer peripheries of the first and second exterior walls 410, 420, a heat insulator (not shown), a pipe hole (not shown), a surface protecting film (not shown), a material and a fabricating method of the block, etc., it may be same as the aforementioned description of the first embodiment.

In the present invention, a plane block (the first to fourth blocks) having a "—" shaped plane was described, however it may be applied to a corner block having a "∟" shaped plane, a three-directional intermediate block having a "⊤" shaped plane, a four-directional intermediate block having a "+" shaped plane, etc.

Figure 13:
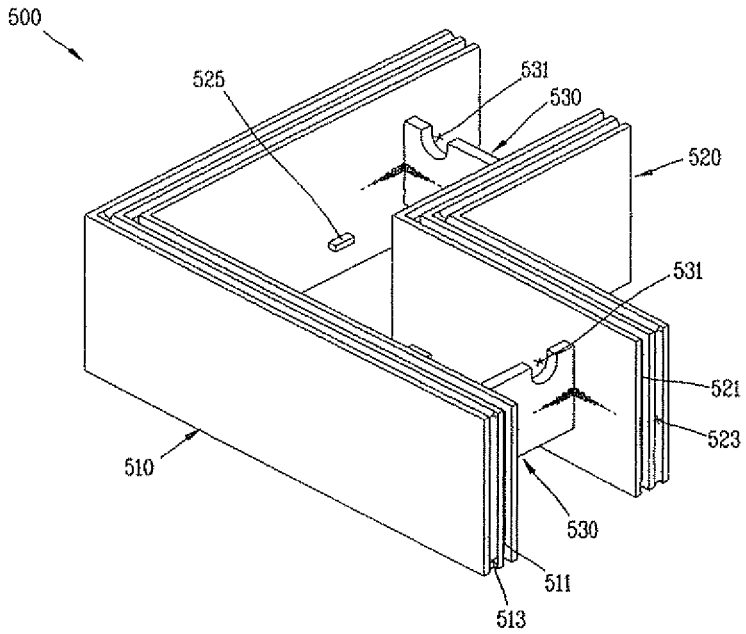
FIG. 13 is a perspective view showing a corner block in accordance with one embodiment of the present invention.

Referring to FIG. 13, a corner block 500 in accordance with one embodiment of the present invention includes first and second exterior walls 510, 520 facing each other and spacing from each other in back and forth directions, and a connecting portion 530 connecting the first and second exterior walls to each other and having an upper portion provided with a first mounting groove 531 for mounting a width-directional reinforcing bar. Here, concavo-convex coupling portions 511, 521 are respectively formed at each inner periphery of the first and second exterior walls 510, 520. Particularly, all of the inner peripheries of the first and second exterior walls 510, 520 are concave portions. The corner block 500 is coupled to the second block 200 within the same line, and upwardly and downwardly coupled to a following corner block 500*a* disposed at upper and/or lower lines thereof, in the concavo-convex manner. And, leakage preventing recesses 513, 523 are respectively formed at each outer periphery of the first and second exterior walls 510, 520.

Figure 14:
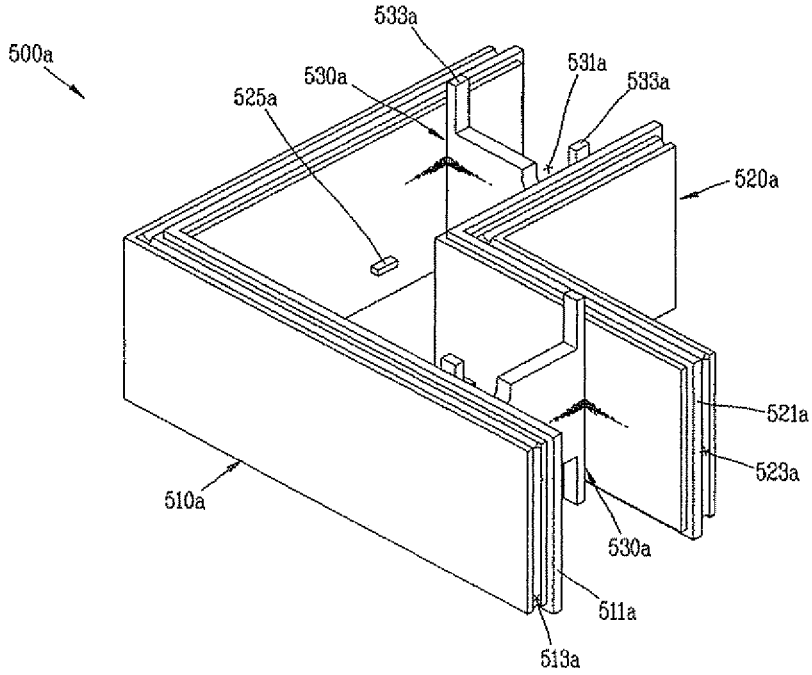
FIG. 14 is a perspective view showing a corner block in accordance with another embodiment of the present invention.

Referring to FIG. 14, the corner block 500*a* in accordance with another embodiment of the present invention has the same configuration as the aforementioned corner block 500 excepting shapes of concavo-convex coupling portions 511*a*, 521*a* and a connecting portion 530*a*. All of inner peripheries of first and second exterior walls 510*a*, 520*a* are convex portions. The corner block 500*a* is coupled to the fourth block 400 within the same line, and upwardly and downwardly coupled to the corner block 500 disposed at upper and/or lower lines thereof, in the concavo-convex manner. The corner blocks 500, 500*a* may have lengths different from each other.

Figure 15:
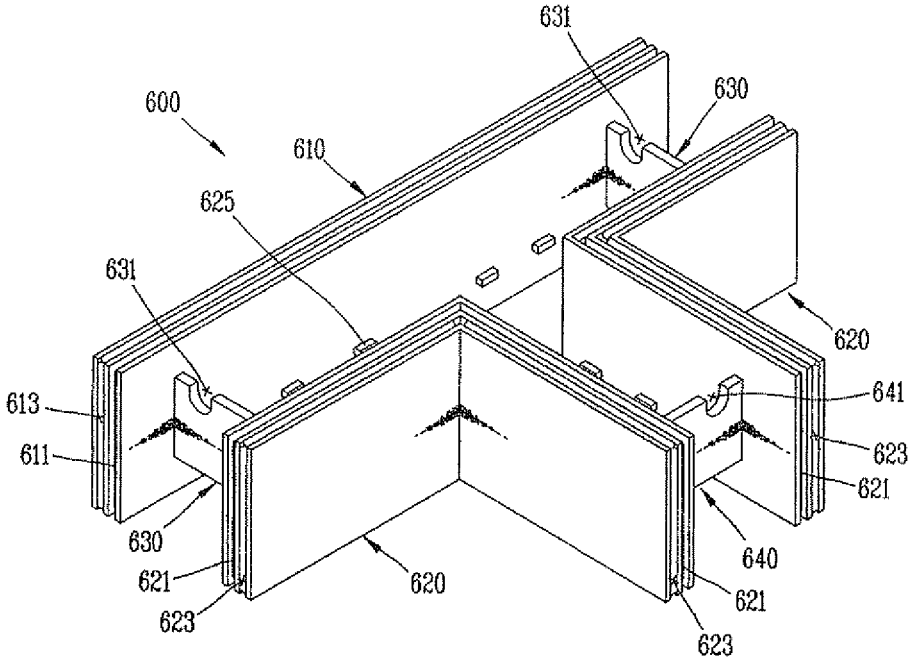
FIG. 15 is a perspective view showing a three-directional intermediate block in accordance with one embodiment of the present invention.

Referring to FIG. 15, a three-directional intermediate block 600 in accordance with one embodiment of the present invention includes first and second exterior walls 610, 620, and a connecting portion 630 connecting the first and second exterior walls to each other and having an upper portion provided with a first mounting groove 631 for mounting a width-directional reinforcing bar. Here, the second exterior wall has planes divided into a "ㄱ" shaped portion and a "ㄱ" shaped portion, and is provided with a connecting portion 640 connecting the two portions of the second exterior wall to each other and having an upper portion provided with a mounting groove 641 for mounting a width-directional reinforcing bar. Here, concavo-convex coupling portions 611, 621 are respectively formed at each inner periphery of the first and second exterior walls 610, 620. Particularly, all of the inner peripheries of the first and second exterior walls 610, 620 are concave portions. The three-directional intermediate block 600 is coupled to the second block 200 within the same line, and upwardly and downwardly coupled to a following three-directional intermediate block 600*a* disposed at upper and/or lower lines thereof, in the concavo-convex manner. And, leakage preventing recesses 613, 623 are respectively formed at each outer periphery of the first and second exterior walls 610, 620.

Figure 16:
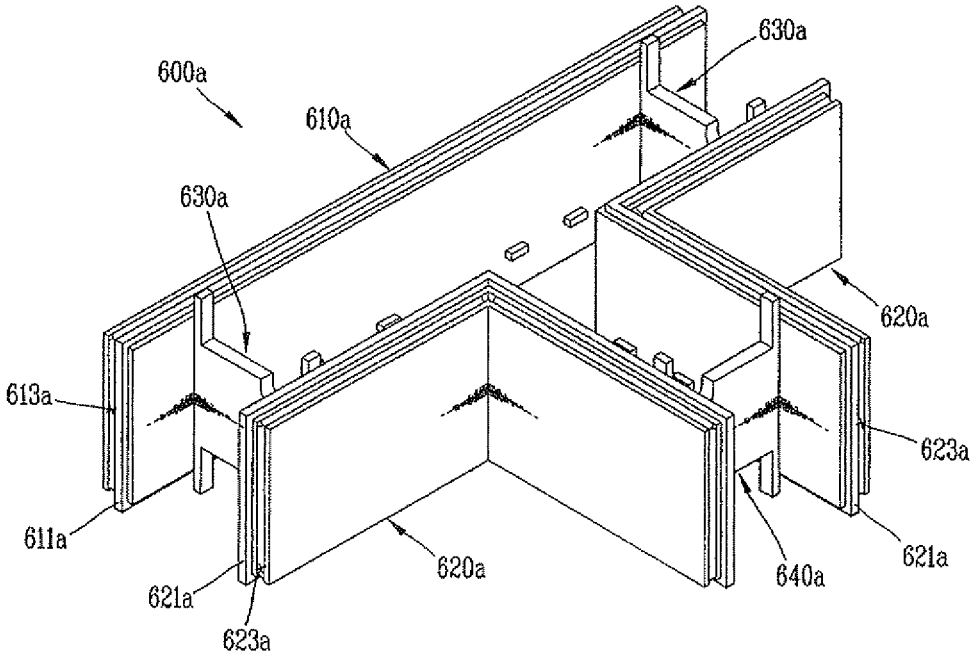
FIG. 16 is a perspective view showing a three-directional intermediate block in accordance with another embodiment of the present invention.

Referring to FIG. 16, the three-directional intermediate block 600*a* in accordance with another embodiment of the present invention has the same configuration as the aforementioned three-directional intermediate block 600 excepting shapes of concavo-convex coupling portions 611*a*, 621*a* and connecting portions 630*a*, 640*a*. All of inner peripheries of first and second exterior walls 610*a*, 620*a* are convex portions. The three-directional intermediate block 600*a* is coupled to the fourth block 400 within the same line, and upwardly and downwardly coupled to the three-directional intermediate block 600 disposed at upper and/or lower lines thereof, in the concavo-convex manner. The three-directional intermediate blocks 600, 600*a* may have lengths different from each other.

Figure 17:
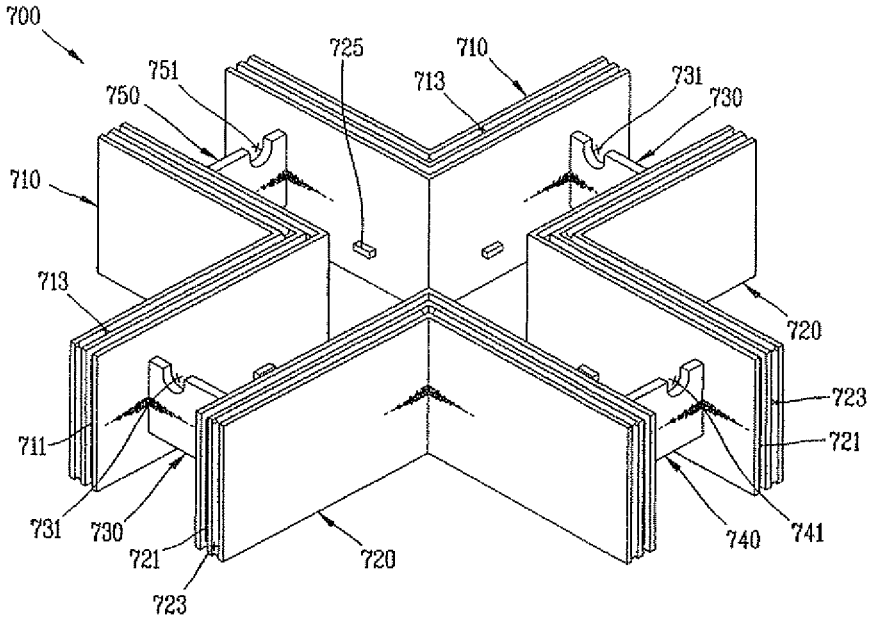
FIG. 17 is a perspective view showing a four-directional intermediate block in accordance with one embodiment of the present invention.

Referring to FIG. 17, a four-directional intermediate block 700 in accordance with one embodiment of the present invention includes first and second exterior walls 710, 720, and a connecting portion 730 connecting the first and second exterior walls to each other and having an upper portion provided with a first mounting groove 731 for mounting a width-directional reinforcing bar. Here, the first exterior wall 710 has planes divided into a "ㅗ" shaped portion and a "ㄴ" shaped portion, and is provided with a connecting portion 750 connecting the two portions of the first exterior wall to each other and having an upper portion provided with a mounting groove 751 for mounting a width-directional reinforcing bar. And, the second exterior wall 720 has planes divided into a "ㅜ" shaped portion and a "ㄱ" shaped portion, and is provided with a connecting portion 740 connecting the two portions of the second exterior wall to each other and having an upper portion provided with a mounting groove 741 for mounting the width directional reinforcing bar. Here, concavo-convex coupling portions 711, 721 are respectively formed at each inner periphery of the first and second exterior walls 710, 720. Particularly, all of the inner peripheries of the first and second exterior walls 710, 720 are concave portions. The four-directional intermediate block 700 is concavo-convexly coupled to the second block 200 within the same line. And, leakage preventing recesses 713, 723 are respectively formed at each outer periphery of the first and second exterior walls 710, 720.

Figure 18:
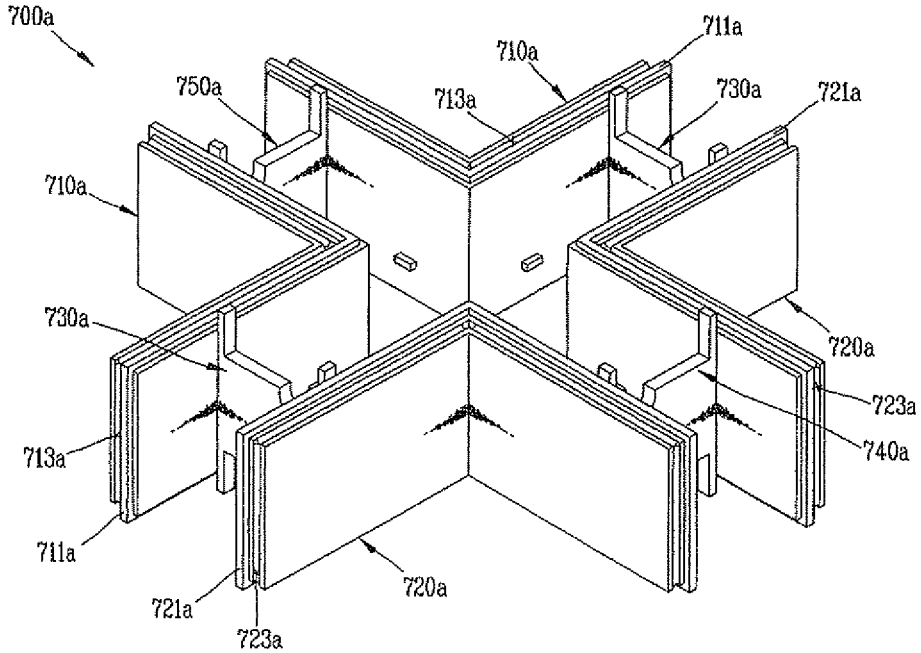
FIG. 18 is a perspective view showing a four-directional intermediate block in accordance with another embodiment of the present invention.

Referring to FIG. 18, a four-directional intermediate block 700*a* in accordance with another embodiment of the present invention has the same configuration as the aforementioned four-directional intermediate block 700 excepting shapes of concavo-convex coupling portions 711*a*, 721*a* and connecting portions 730*a*, 740*a*, 750*a*. All of inner peripheries of first and second exterior walls 710*a*, 720*a* are convex portions. The four-directional intermediate block 700*a* is coupled to the fourth block 400 within the same line, and upwardly and downwardly coupled to the four-directional intermediate block 700 disposed at upper and/or lower lines thereof, in the concavo-convex manner. The four-directional intermediate blocks 700, 700*a* may have lengths different from each other.

Figure 19:
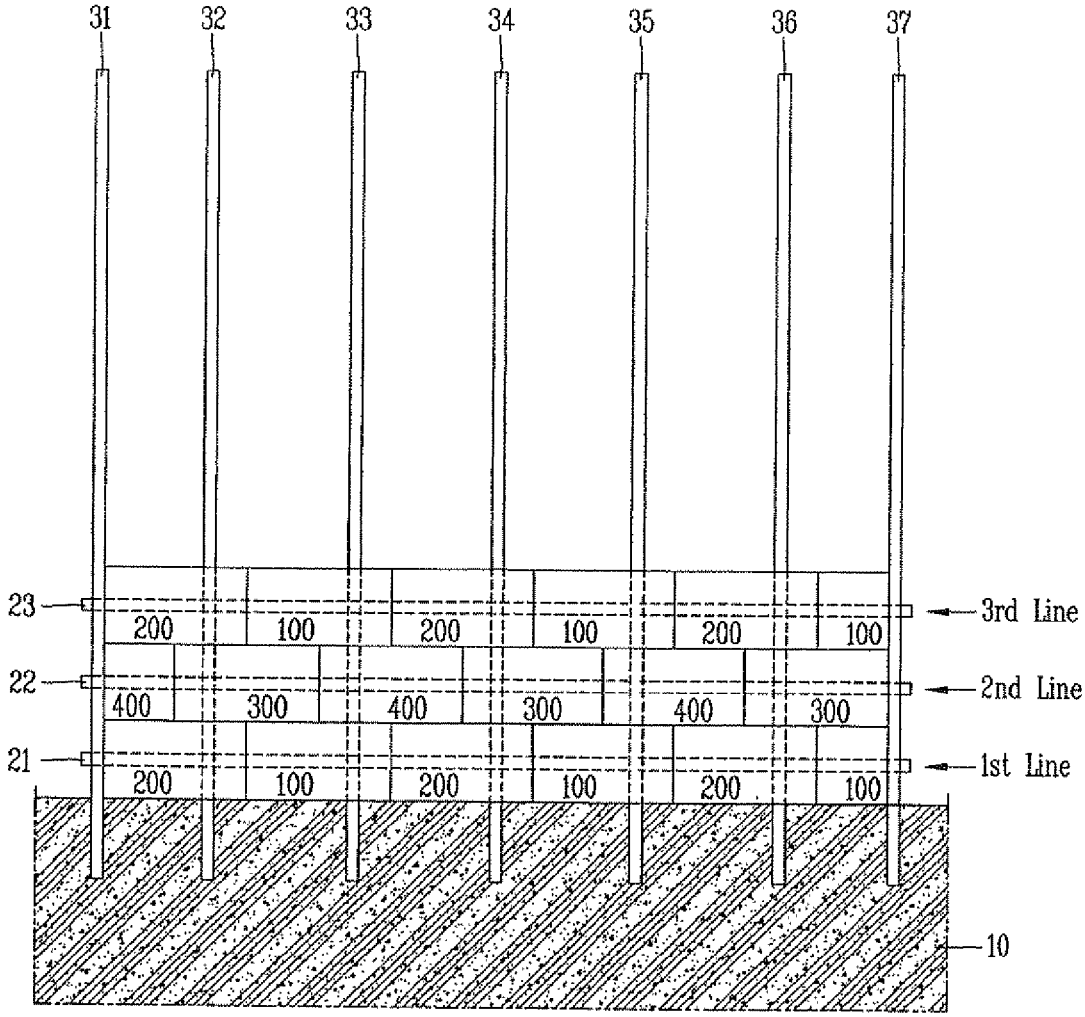
FIG. 19 is a schematic front perspective view showing that building blocks are bricked and width-directional and length-directional reinforcing bars are placed.
Figure 20:
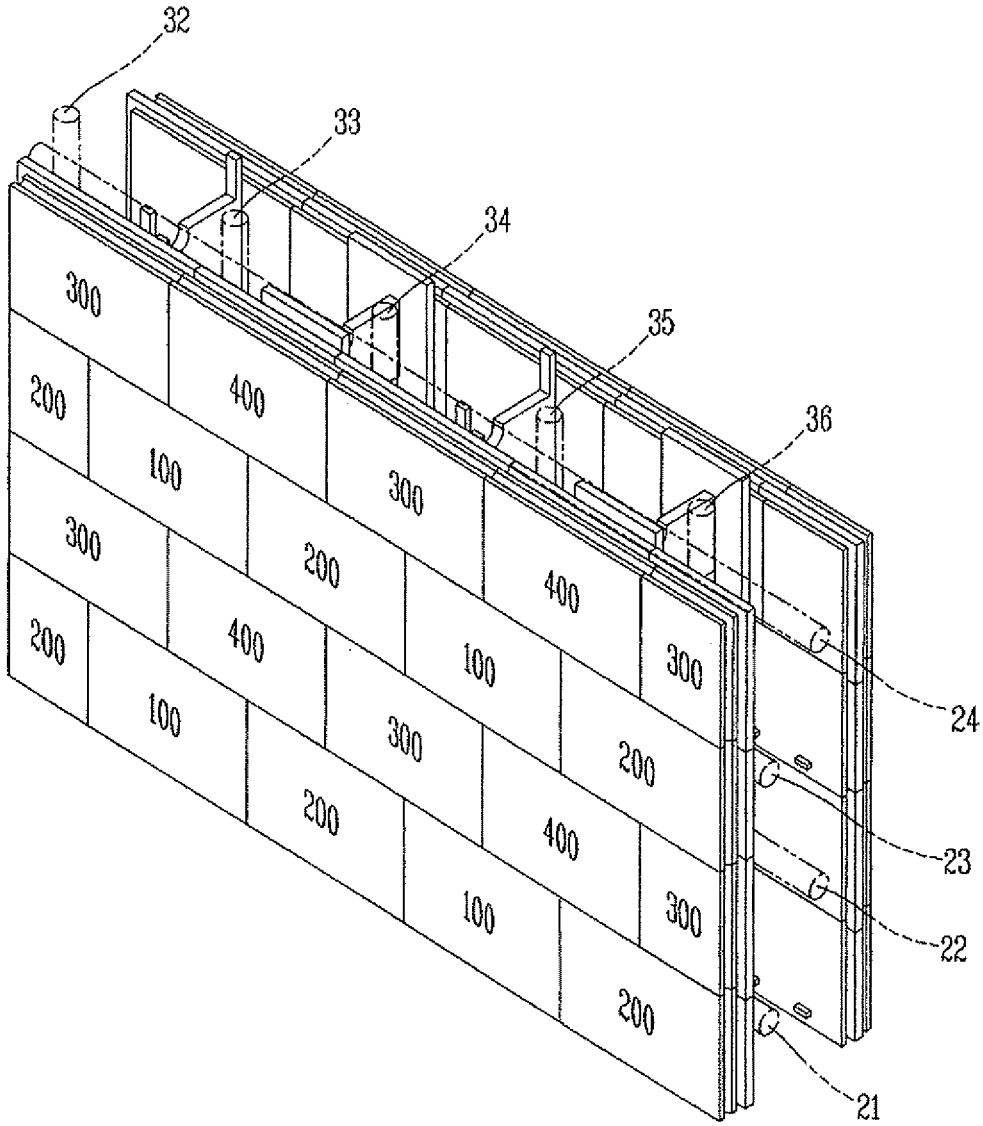
FIG. 20 is a partial assembly perspective view showing a building structure using building blocks in accordance with one embodiment of the present invention.

Hereafter, one exemplary method of bricking a wall using the first to fourth blocks 100, 200, 300, 400 will be described with reference to FIGS. 19 and 20. Description regarding the method of bricking a wall using a building block includes the description regarding a building structure of the present invention.

First, cement mortar 10 is cast on a ground to be bricked.

Thereafter, a first line is bricked over the cement mortar 10. That is, after performing a bonding process for the concavo-convex portions of the first and/or second blocks 100, 200, the first block 100 and the second block 200 are concavo-convexly coupled in right and left directions, alternatively, and adhered to each other. Then, a width-directional reinforcing bar 21 is mounted at the first mounting grooves of the first and second blocks 100, 200. Upon concavo-convexly coupling the first block 100 and the second block 200 to each other, each leakage preventing recess formed at each outer periphery of each exterior wall of the blocks also comes into contact with each other, thus forms a connecting passage for leakage water. It doesn't matter which process precedes between the placing of the width-directional reinforcing bar 21 and the bricking of the first and second blocks 100, 200.

Thereafter, a second line is bricked over the first line. That is, after performing the bonding process for the concavo-convex coupling portions of the third and/or fourth blocks 100, 200, the third block 300 and the fourth block 400 are concavo-convexly coupled in right and left directions, alternatively, and adhered to each other. Then, a width-directional reinforcing bar 22 is mounted at the first mounting grooves of the third and fourth blocks 300, 400. Here, the third block 300 is simultaneously coupled and adhered to upper ends of the first and second blocks 100, 200, and the fourth block 400 is simultaneously coupled and adhered to the upper ends of the first and second blocks 100, 200 so as to perform the brick work (i.e., masonry) zigzag. When the third block 300 and the fourth block 400 are concavo-convexly coupled in the right and left directions over the first and second blocks 100, 200, each leakage preventing recess formed at each outer periphery (upper, lower, right and left) of each exterior wall of the blocks also comes into contact with each other, thus forms a connecting passage for leakage water. Further, preferably, the width-directional reinforcing bar 21 of the first line and the width-directional reinforcing bar 22 of the second line are zigzag placed back and forth so as to prevent the reinforcing bars from gathering together. It doesn't matter which process precedes between the placing of the width-directional reinforcing bar 22 and the bricking of the third and fourth blocks 300, 400.

Thereafter, length-directional reinforcing bars are placed in the first to fourth blocks. The length-directional reinforcing bars 33, 34, as shown, may simultaneously pass through the first and fourth blocks 100, 400, and the second and third blocks 200, 300, respectively in the length direction. Alternately, though it is not shown, the length-directional reinforcing bars 33, 34 may simultaneously pass through the first and third blocks, and the second and fourth blocks, respectively in the length direction. The placing of the length-directional reinforcing bars may be performed after the bricking of the first line or the bricking of the third line.

Thereafter, a third line is bricked over the second line. The third line is bricked by the method same as that of the first line. But, the first block 100 of the third line is simultaneously coupled and adhered to upper ends of the third and fourth blocks 300, 400 of the second line, and the second block 200 of the third line is simultaneously coupled and adhered to the upper ends of the third and fourth blocks 300, 400 of the second line.

Thereafter, the cement mortar is cast at once along the third line. Accordingly, the cement mortar is filled up to the ground through inner spaces of the blocks of the first to third lines, thus the brick work is partially completed. Preferably, the mortar is filled until it is horizon with the upper end of the connecting portion of the blocks of the third line. Here, the casting work may be performed using yellow ocher, etc. instead of the cement mortar.

With the abovementioned method, when executing the processes such as bricking, placing, mortar filling, etc. for 3 lines, next accumulated 6 lines, next accumulated 9 lines, etc., it is capable of bricking the wall as high as wanted. In this embodiment, the mortar filling is executed whenever performing the brick work by 3 lines, however it is not limited thereto.

In accordance with the present invention, there are advantages as follows.

First, since the block serving as the mold forms the external appearance, it is capable of preventing additional materials from being used, simplifying the construction, drastically reducing the term of works, and easily constructing the building structure by an ordinary person who is not professional.

Second, because of the inner structure of the block itself, it is capable of placing reinforcing bars in length and width directions, increasing a tensile strength of the building structure, and loading the heat insulator in the block, which results in a great insulating effect.

Third, since the blocks are concavo-convexly coupled to each other in the zigzag manner, it is capable of enhancing the tensile strength and durability of the wall, and since the leakage preventing recesses are formed along peripheries of the blocks, it is capable of minimizing the leakage, cracks, efflorescence, etc. of the building structure.

Fourth, it is capable of flexibly creating paintings or patterns on the outer surface when fabricating the block. And, in case that the block is formed of the ceramic material, it is capable of implementing an excellent appearance by itself and effectively preventing the pollution caused by the building materials.

Fifth, since the pipe hole for distributing wires and laying pipes is easily formed, it is not required to break the wall for forming the pipe hole after the bricking process.

Sixth, using the method simpler than the related art, it is capable of drastically reducing the cost and building a permanently lasting building structure.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A building block comprising:

first and second exterior walls facing each other and spaced from each other, each of the walls having an outer face and inner face and a continuous peripheral edge connecting said inner and outer faces and defining a thickness therebetween;

a connecting portion connecting the first and second exterior walls to each other and having an upper portion provided with a first mounting groove for mounting a width-directional reinforcing bar, concavo-convex coupling portions formed at the continuous peripheral edge of the first exterior wall and the continuous peripheral edge of the second exterior walls adjacent the inner face surface, for concavo-convexly coupling to each adjacent block; and a leakage preventing recess formed at the entire peripheral edge of the first exterior wall and the entire peripheral edge of the second exterior walls adjacent the outer face surface.

2. The building block of claim 1, wherein concave portions are formed at the inner peripheries of the first and second exterior walls.

3. The building block of claim 2, wherein the connecting portion has a cross section in a shape of "⊏", and both ends thereof are more protruded than end portions of the first and second exterior walls.

4. The building block of claim 1, further comprising a heat insulator established at a space formed by the first and second exterior walls and the connecting portion.

5. The building block of claim 4, wherein fixing members for fixing the heat insulator are formed at each inner wall of the first and second exterior walls.

6. The building block of claim 4, wherein a second mounting groove for mounting the width-directional reinforcing bar is formed on an upper surface of the heat insulator so as to match the first mounting groove.

7. The building block of claim 1, wherein a pipe hole for distributing a wire or laying a pipe is formed at at least one of the first and second exterior walls.

8. The building block of claim 1, wherein detachable surface protecting films are respectively attached onto outer wall surfaces of the first and second exterior walls.

9. The building block of claim 1, wherein the first and second exterior walls and the connecting portion are formed of a ceramic material.

10. The building block of claim 1, wherein the building block is a plane block having a "—" shaped plane or a corner block having a "ㄴ" shaped plane.

11. The building block of claim 1, wherein the building block is a three-directional intermediate block having a "ㅜ" shaped plane, and wherein the second exterior wall has planes divided into a "ㄱ" shaped portion and a "ㄱ" shaped portion, and is provided with a connecting portion connecting the two portions of the second exterior wall and having an upper portion provided with a mounting groove for mounting a width-directional reinforcing bar.

12. The building block of claim 1, wherein the building block is a four-directional intermediate block having a "ㅜ" shaped plane, and wherein the first exterior wall has planes divided into a "ㄴ" shaped portion and a "ㄴ" shaped portion, the second exterior wall has planes divided into a "ㄱ" shaped portion and a "ㄱ" shaped portion, a connecting portion connecting the two portions of the first exterior wall and having an upper portion provided with a mounting groove for mounting a width-directional reinforcing bar is provided, and a connecting portion connecting the two portions of the second exterior wall and having an upper portion provided with a mounting groove for mounting a width-directional reinforcing bar is provided.

* * * * *